US006510797B1

(12) United States Patent
Fong

(10) Patent No.: US 6,510,797 B1
(45) **Date of Patent: *Jan. 28, 2003**

(54) SEGMENTED KINETIC ENERGY EXPLOSIVELY FORMED PENETRATOR ASSEMBLY

(75) Inventor: Richard Fong, Rockaway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 31 days.

This patent is subject to a terminal disclaimer.

(21) Appl. No.: 09/977,903

(22) Filed: Oct. 12, 2001

Related U.S. Application Data

(63) Continuation-in-part of application No. 09/641,957, filed on Aug. 21, 2000, now abandoned, and a continuation-in-part of application No. 09/651,228, filed on Aug. 17, 2000, now Pat. No. 6,308,634.

(51) Int. Cl.[7] ..... F42B 12/10
(52) U.S. Cl. ..... 102/476; 102/307; 102/501
(58) Field of Search ..... 102/306–310, 102/476, 501

(56) References Cited

U.S. PATENT DOCUMENTS 4,841,864 A * 6/1989 Grace ..... 102/307
5,033,387 A * 7/1991 Lips ..... 102/476
5,753,850 A * 5/1998 Chawla et al. ..... 102/476
5,792,980 A * 8/1998 Weimann ..... 102/476
6,186,070 B1 * 2/2001 Fong et al. ..... 102/476
6,250,229 B1 * 6/2001 Kerdraon et al. ..... 102/476
6,308,634 B1 * 10/2001 Fong ..... 102/476

* cited by examiner

*Primary Examiner*—Harold J. Tudor
(74) *Attorney, Agent, or Firm*—John F. Moran; Michael C. Sachs

(57) ABSTRACT

A segmented, kinetic energy projectile is formed by stacking several liners in a single warhead, for effectively producing a longer penetrator capable of greatly enhancing penetration. Each individual liner forms a separate penetrator, so that the liners are successively fired and allow for a greater overall target penetration. In one embodiment, the flight path of at least one liner is diverted from the flight paths of the other liners, so that the liners could attack several adjacent targets or provide multiple penetrations. The EFP assembly has the additional capability of utilizing a single warhead that incorporates multiple hits mechanisms. The EFP assembly includes multiple liners that are separated by multiple separators. The separators are non-symmetrically disposed relative to each other, in order to divert the liners toward multiple targets. The liners are diverted from a reference trajectory because the separators impart different angles to the liners. Alternatively, the liners can be deviated from the reference trajectory, by varying the densities of the liners, or by varying their thicknesses.

8 Claims, 8 Drawing Sheets

SEGMENTED KINETIC ENERGY EXPLOSIVELY FORMED PENETRATOR ASSEMBLY

CROSS-REFERENCE TO RELATED APPLICATIONS

This application is a continuation-in-part application of U.S. patent application Ser. No. 09/641,957, titled "Segmented Kinetic Energy Explosively Formed Penetrator Assembly", filed on Aug. 21, 2000, now abandoned, and U.S. patent application Ser. No. 09/651,228, titled "Precursor-Follow Through Explosively Formed Penetrator Assembly", filed on Aug. 17, 2000, now U.S. Pat. No. 6,308,634 both of which patent applications are incorporated herein by reference in their entirety.

GOVERNMENTAL INTEREST

The invention described herein may be manufactured and used by or for the Government of the United States for governmental purposes.

FIELD OF THE INVENTION

This invention generally relates to the field of ballistics, and it particularly relates to explosively formed projectiles (EFP). More specifically, this invention relates to a segmented, multi-liner, kinetic energy explosively formed penetrator, to achieve greater penetration.

BACKGROUND OF THE INVENTION

The concept of using explosive energy to deform a metal plate into a coherent penetrator while simultaneously accelerating it to extremely high velocities offers a unique method of employing a kinetic energy penetrator without the use of a large gun. A typical explosively formed projectile (EFP) is comprised of a metallic liner, a case, an explosive section, and an initiation train. Very often there is also a retaining ring to position and hold the liner-explosive subassembly in place. EFP warheads are normally designed to produce a single massive, high velocity penetrator. After detonation, the explosive products create enormous pressures that accelerate the liner while simultaneously reshaping it into a rod or some other desired shape. The EFP then hits the target at a high speed, delivering a significantly high mechanical power.

Two major applications have evolved for explosively formed projectiles or warheads, namely, long-standoff sensor-fuzed submunitions and medium standoff, close-overflight missiles. The former application, which is the more traditional one, requires the formation of a single-piece EFP capable of flying in a stable fashion to the target. This refinement has led to the flared EFP rod and, more recently, to the finned EFP rod designs.

For the medium or short-standoff applications, a new type of EFP was developed. The need for an aerodynamic shape is not necessary for these applications because of the short distance the EFP must travel, hence, the length of the rod was increased and the flared tail was eliminated from the design. In fact, some of these rods are purposely stretched beyond their breaking point and fracture into several pieces resulting in greater total length.

An EFP warhead configuration may be comprised of a steel case, a high-explosive charge, and a metallic liner. Explosively formed penetrator (EFP) warheads have been designed to project a single massive high velocity penetrator to attack the top of armored vehicles. Such armor perforation capability needs further improvement to counter new generations of harder armored vehicles, without resorting to a larger caliber weapon system. In developing a warhead configuration that meets system constraints and also meets performance requirements, several parameters in the warhead configuration must be redesigned to achieve an optimum configuration. Several warhead configurations have been developed to accommodate varying system constraints.

SUMMARY OF THE INVENTION

It is an object of the present invention to satisfactorily address the foregoing need and to form a new segmented, multi-liner, kinetic energy projectile by stacking several liners in a single warhead, for effectively producing a longer penetrator capable of greatly enhancing penetration. Each individual liner forms a separate penetrator, so that the liners are successively fired and allow for a greater overall target penetration.

In one embodiment, the flight path of at least one liner is diverted from the flight paths of the other liners, so that the liners could attack several adjacent targets or provide multiple penetrations. Potential targets include tanks, light armored vehicles, ships, submarines, ballistic missiles, aircraft and bunkers.

The foregoing and additional features of the present invention are realized by an explosively formed penetrator warhead that incorporates several, for example 10 separate liners. Each liner forms a separate penetrator of a given length with each penetrator spaced on a common trajectory for multiple hits for increased effectiveness against reactive or multiple plate targets. The trajectory of each penetrator could also be diverted to impact over an area. The individual liners can be fabricated from various materials including copper, iron, and tantalum, and others discussed below.

The liners can have different masses and curvatures to control their velocity, separation and trajectory. Through the use of various liner materials, incendiary follow-through effects could be introduced. The use of various buffer materials between liners can vary the separation distances.

In another embodiment, the EFP assembly includes two sections: an initial precursor penetrator followed by a penetrator that encapsulates a reactive material. This will greatly enhance the lethality of the warhead against certain targets, and particularly targets consisting of multi layers or multi compartments. These targets will initially be perforated by the precursor penetrator with the second follow through penetrator containing a reactive material causing internal damage through a secondary reaction. Potential targets include tanks, ships, ballistic missiles, aircraft and bunkers.

The EFP warhead or assembly of the present invention is comprised of the following major components: a copper liner, a reactive material, an explosive billet or charge, a backplate, an aluminum housing, and a detonator assembly for initiating the explosive billet. When the explosive billet is initiated by the detonator assembly, it causes the liner to be accelerated forward with the outer edges folding forward to form or mold the reactive material in a desired aerodynamic shape. The forward folding penetrator then separates into two sections, a precursor and a follow through penetrator. The precursor impacts and penetrates the target with the follow through penetrator containing a reactive material entering the target and causing a secondary reaction.

According to still another embodiment of the present invention, the EFP assembly has the additional capability of utilizing a single warhead that incorporates multiple hits mechanisms. In one specific embodiment of the EFP assembly, one of the expelled liners contains the reactive material 70 which further destroys, or neutralizes, or otherwise reacts with, whatever it comes into contact with.

In this latter embodiment, the EFP assembly includes multiple liners that are separated by multiple separators. The separators are non-symmetrically disposed relative to each other, in order to divert the liners toward multiple targets. The liners could fold either forwardly or rearwardly, or they could maintain their original or another desired shape along their respective trajectories. The liners are diverted from a reference trajectory because the separators impart different angles to the liners.

When the explosive shock wave comes in contact with the angled separators, the normal pressure forces are translated at their respective angles of deviation from the reference trajectory, to the next liner in the configuration, causing the latter liner to be propelled towards its designated target at that given angle of deviation.

According to another embodiment of the present invention, the liners can be deviated from a reference trajectory, by varying the densities or other characteristics of the liners. The variable densities of the seperators (or liners) vary the separation distances between them.

According to still another embodiment, the separators can have varying thicknesses in order to vary the separation thicknesses between the liners.

BRIEF DESCRIPTION OF THE DRAWINGS

The above and other features of the present invention and the manner of attaining them, will become apparent, and the invention itself will be best understood, by reference to the following description and the accompanying drawings, wherein.

Similar numerals refer to similar elements in the drawings. It should be understood that the sizes of the different components in the figures are not necessarily in exact proportion or to scale, and are shown for visual clarity and for the purpose of explanation.

DETAILED DESCRIPTION OF THE INVENTION

Figure 1:
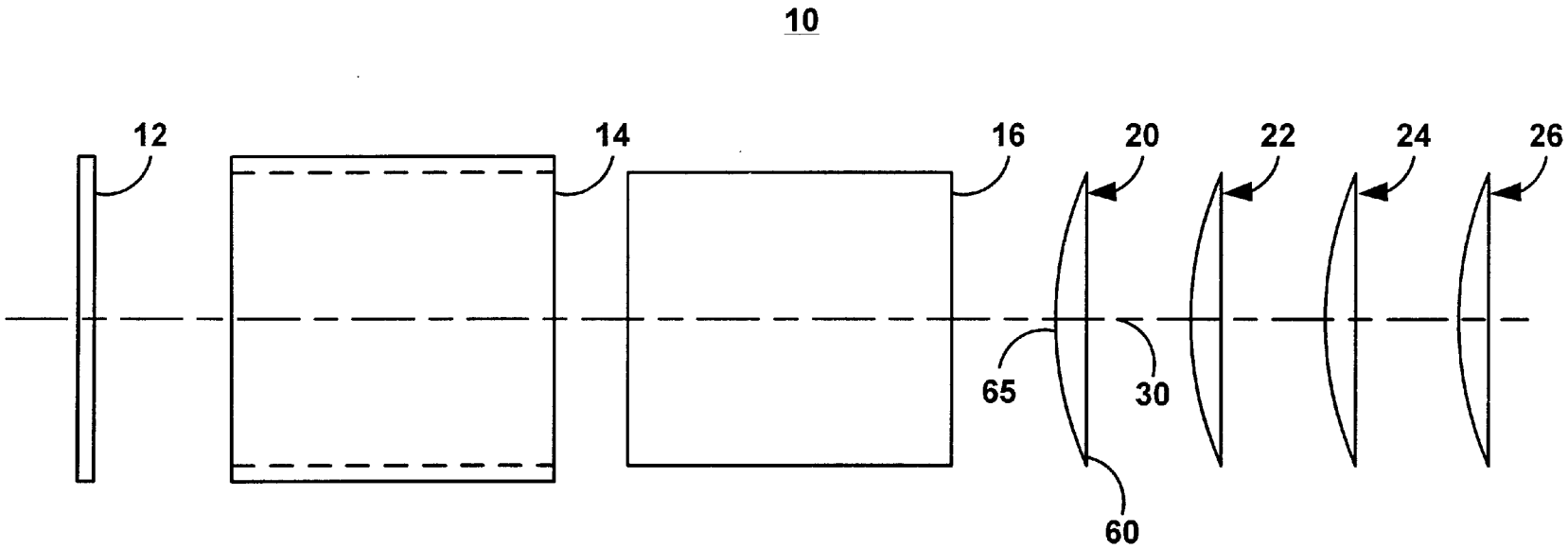
FIG. 1 is a schematic, exploded, cross-sectional, side elevational view of a segmented, multi-liner, kinetic energy, explosively formed projectile (EFP) assembly according to the present invention.
Figure 2:
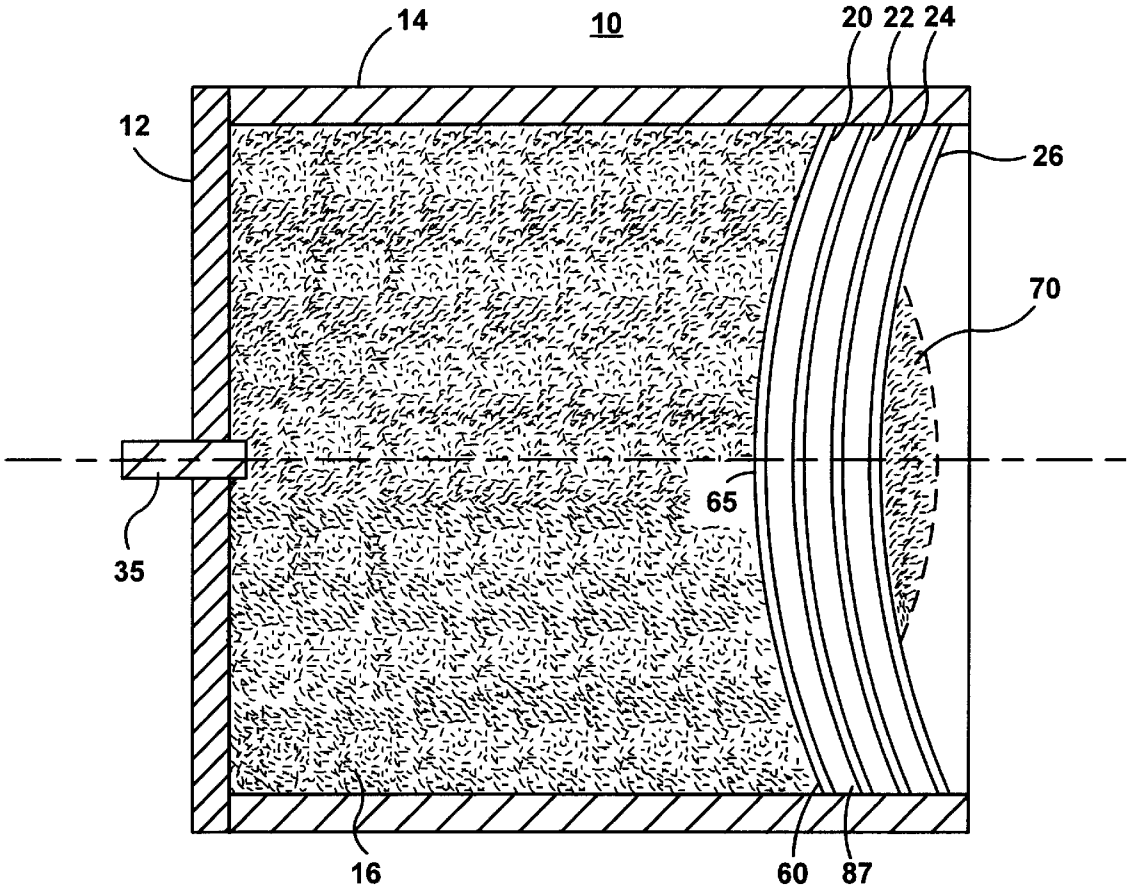
FIG. 2 is a schematic, cross-sectional, side elevational view of the segmented, explosively formed projectile assembly of FIG. 1, shown assembled.

FIGS. 1 and 2 illustrate an exemplary embodiment of a segmented kinetic energy explosively formed projectile (EFP) assembly 10 according to the present invention. The EFP assembly 10 generally includes a backplate 12, a housing 14, an explosive billet 16, and a plurality of separate liners, only four of which, 20, 22, 24, and 26 are shown for illustration purposes. These components are assembled along a central axis 30.

The backplate 12 and the housing 14 provide a protective casing for the explosive billet 16 and the liners 20, 22, 24, and 26. In addition, the mass of the housing 14 provides confinement for the explosive billet 16. The addition of mass around the explosive billet 16 and the liners 20, 22, 24, and 26 increases the duration of the explosive impulse and hence the total energy delivered to the liners 20, 22, 24, and 26. The material of choice for the backplate 12 and the housing 14 is typically steel because of its relative low cost, high strength, and density. However, other materials can alternatively be used, (such as aluminum), as long as the mass is sufficient to provide the necessary confinement.

The density and the physical dimensions of the explosive billet 16 are also of major importance, as they affect the deformation of the individual projectiles from the liners 20, 22, 24, and 26.

Each of the liners 20, 22, 24, and 26 is stacked on the explosive billet 16, forms a separate penetrator, as it will be described later in greater detail in connection with FIG. 3. When the explosive billet 16 is initiated by a detonator assembly 35 (FIG. 2), it causes the liners 20, 22, 24, and 26 to form individual collinear penetrators that separate and follow each other on a common trajectory 50. Such detonator is physically positioned between back plate 12 and the back end of explosive 16. Ordinarily a shock wave is propagated because of the explosive burning of the billet, in the form of ever expanding hemispheres that are concentric around the detonation point (if there is a single point of detonation). However, with spaced apart, judiciously placed multiple points of detonation, the shock wave front could be more nearly like a plurality of plane waves, propagating straight forward down the housing towards the liner(s), and being nearly plane perpendicular to the central axis of the housing. With plane waves rather than hemispherical type, e.g., it gives improved chance to impart as much pressure as possible to the liner(s) to deform and propel same. The detonator might comprise RDX, PETN, RXN, for example, and could be arranged in many detonation configurations, such as by a high voltage detonator into an explosive train, or by a standard Army blasting cap, a line detonator across the back end of the explosive billet, or even plural line detonators that intersect at near equal angles through the center of the back end of the explosive billet. Electrical wires may be run out between the back plate and back end of the explosive billet, if needed. There is a detonation delay of for instance, 15 microseconds, causing perhaps a 5 Kilobar shock wave to propagate down the explosive until it reaches the area of the liner (s). With more powerful explosives or perhaps with multiple simultaneous detonations of the explosive, a 6 Kilobar shock wave might be generated.

In FIG. 1, section 12 forms a backplate placed flush to a hollow cylindrical housing 14 which has an inside diameter that could be 3 to 6 inches. The cylindrical shaped explosive (billet) 16 could be made of LX-14, OCTOL, or Hand packed C-4, or some other solid explosive, and it can be machined to fit snugly within the inside of the housing, as well as to have a countersunk recess in its forward end, to receive snug placement of a liner or liners, as may be needed.

With reference to FIGS. 1 and 2, the liners 20, 22, 24, and 26 are curved and are generally dome (or bell) shaped. Each liner, i.e., 20, has a generally circular peripheral rim 60 and a concave surface 65. The liners 20, 22, 24, and 26 are stacked inside the housing 14 against the explosive billet 16 such that the concave surfaces 65 of the liners 20, 22, 24, and 26 are curved toward the backplate 12. The rims 60 of the liners 20, 22, 24, and 26 abut against and are secured to the inner surface of the housing 14. The material of choice for the liners 20, 22, 24, and 26 can be iron, tantalum, copper, or a material of like composition. The liners could also be made of iron, or metallic materials such as silver, tungsten, or depleted uranium. The liners might be 0.100 inch thick if of copper, or 0.120 inch thick if of Tantalum. The speed of impact could be 2 Kilometers per second if the liners were made of Tantalum, or 2.7 Kilometers per second if the liners were made of Copper. There could be as many as 5 to 10 additional liner(s) stacked together. In operation, each results in a penetrator that in sequence will hammer away at the target material, in cumulative hammer blows that do more damage to the target than would be done with a single, or by fewer, penetrator(s), or by a large amount of explosive, e.g. The number of liners possible seems limited only by the explosive strength of the billet 16 in its housing, for the most part. The liners could be mounted together physically, in the explosive billet's end, by a retaining ring around the liner end of the explosive billet, or even held together by glue or some bonding material, with or without a retaining ring. Although the liners are shown here as tapered, concave shaped, lens-like, they could also in practice be made as disc-shaped, of uniform thickness, with round circumference.

Optionally, and as described herein in more detail, a reactive material 70 partly fills the outermost liner 26 in order to form a two-stage penetrator of the outermost liner 26. The reactive material can be any material that causes an enhanced effect which can not be caused by the main warhead. The reactive material 70 can become reactive when it comes into contact with a second material that is not part of the main warhead, or when a certain condition is met. Examples of the reactive material 70 include, without limitation, neutralizing agents to counteract hazardous materials, or grenade type features to destroy the inner structures of a given target.

As illustrated in FIG. 2, successive liners i.e., (20, 22), (22, 24), (24, 26) are separated by a predetermined distance. When the liners 20, 22, 24, and 26 are fired from the EFP assembly 10, the separation distance between two successive liners eventually translates into time delay for impacting a target (FIG. 3).

In one embodiment, the separation distance between successive liners 20, 22, 24, and 26 is identical. In another embodiment, this separation distance varies between the liners 20, 22, 24, and 26, to regulate the impact times of the various liners 20, 22, 24, and 26 against the target. The liners 20, 22, 24, and 26 can be separated by any material of choice, such as can be iron, tantalum, copper, or a material of like composition.

Figure 3:
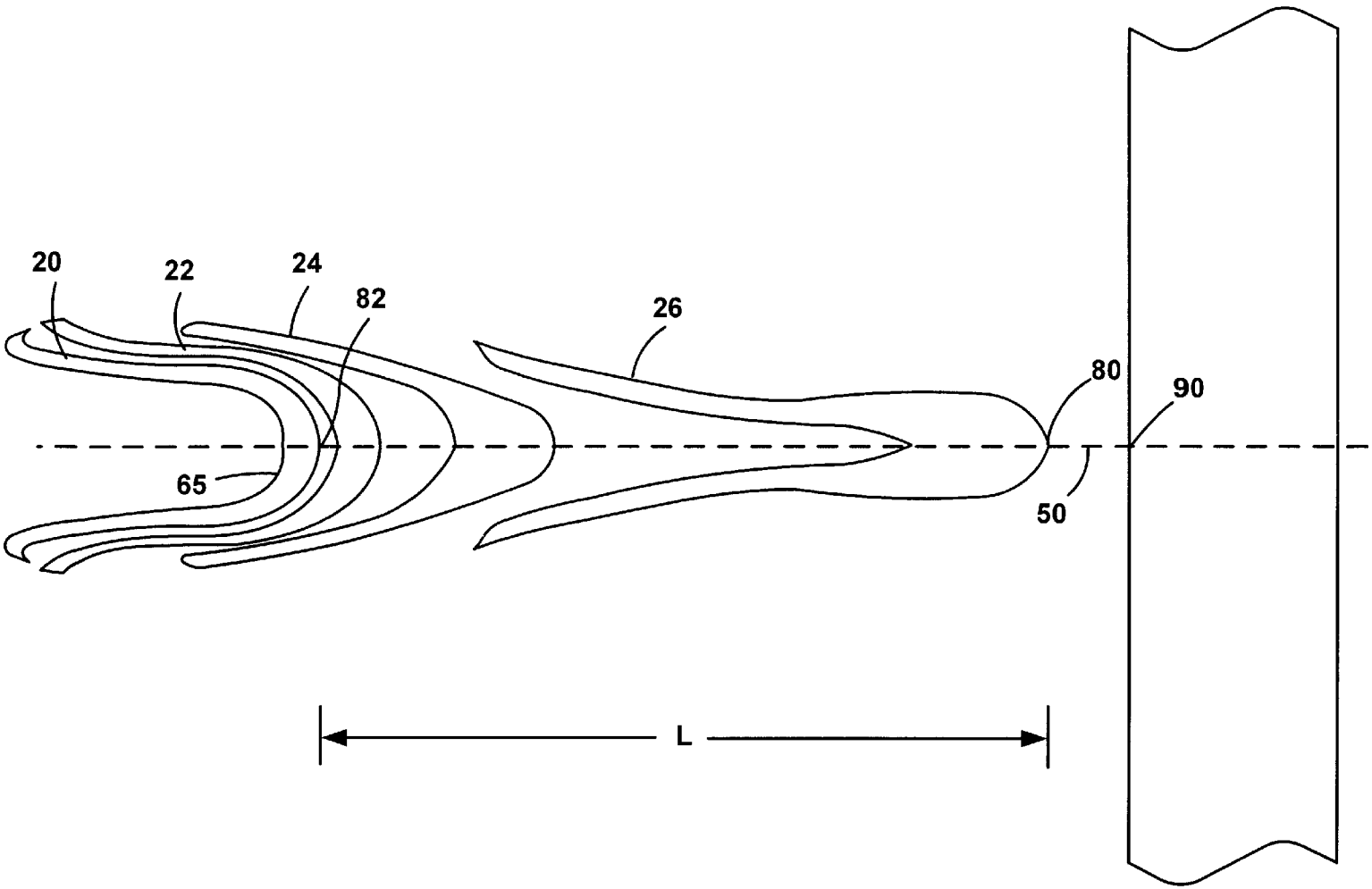
FIG. 3 is a view of four individual liners that form part of the explosively formed projectile assembly of FIGS. 1 and 2, shown after they have been fired, traveling in tandem, along a single trajectory just before they impact a target.

When the detonator assembly 35 is fired from a gun (not shown), and the detonator assembly 35 initiates the explosive billet 16, the outermost liner 26 is forced and folded rearward in a convex shape, as illustrated in FIG. 3, and continues to deform as it travels along the trajectory 50 toward the target.

Figure 4:
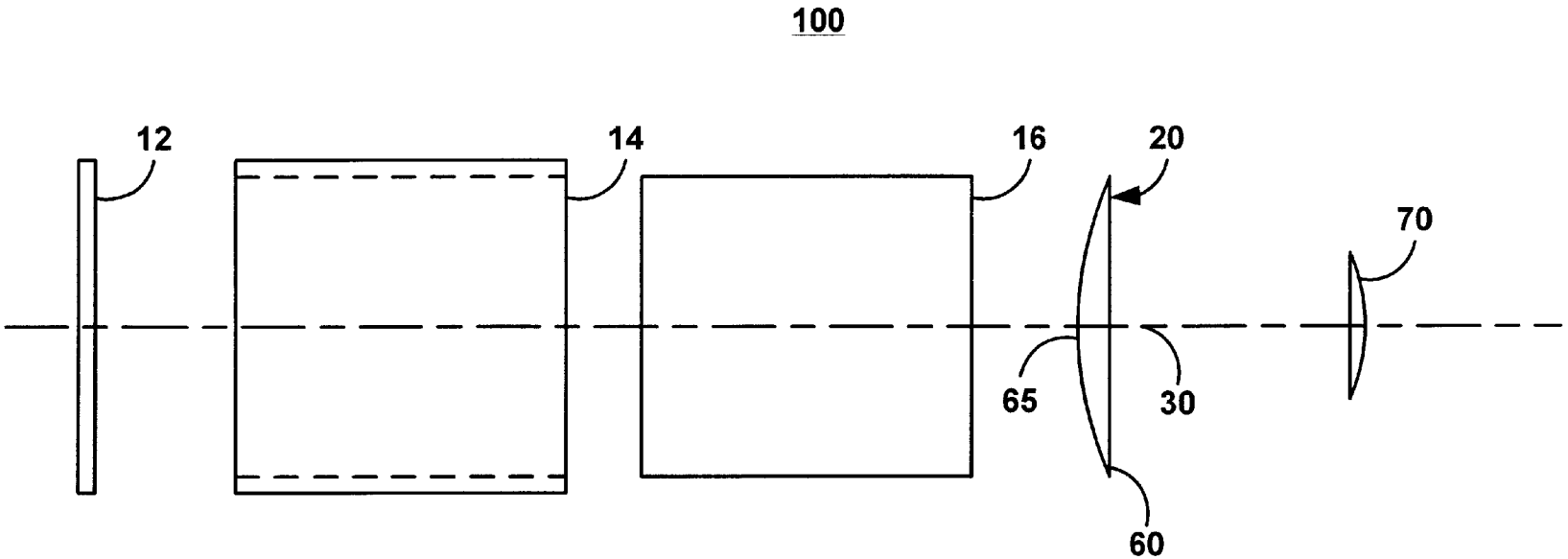
FIG. 4 is a schematic, exploded, cross-sectional, side elevational view of a precursor-follow through kinetic energy explosively formed penetrator (EFP) assembly according to the present invention.
Figure 5:
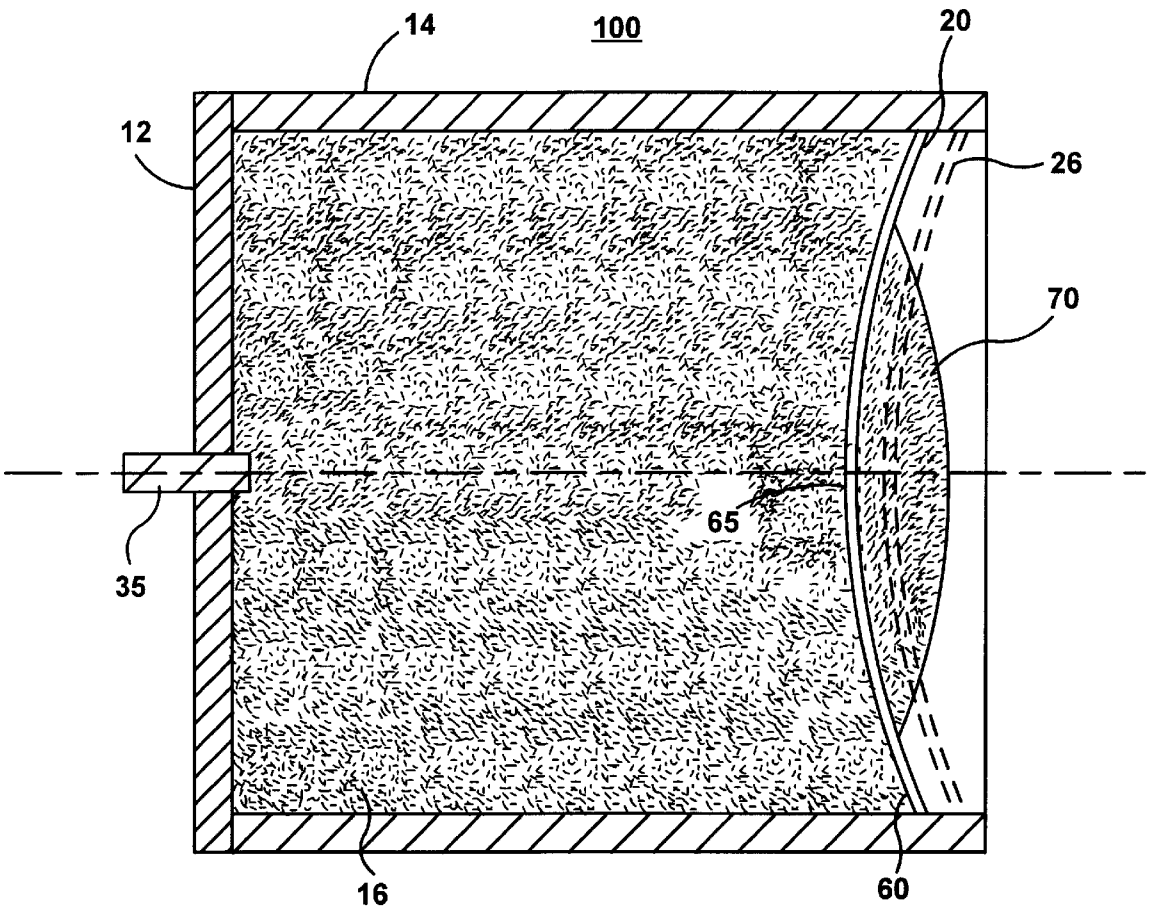
FIG. 5 is a schematic, cross-sectional, side elevational view of the EFP assembly of FIG. 4, shown assembled.
Figure 6:
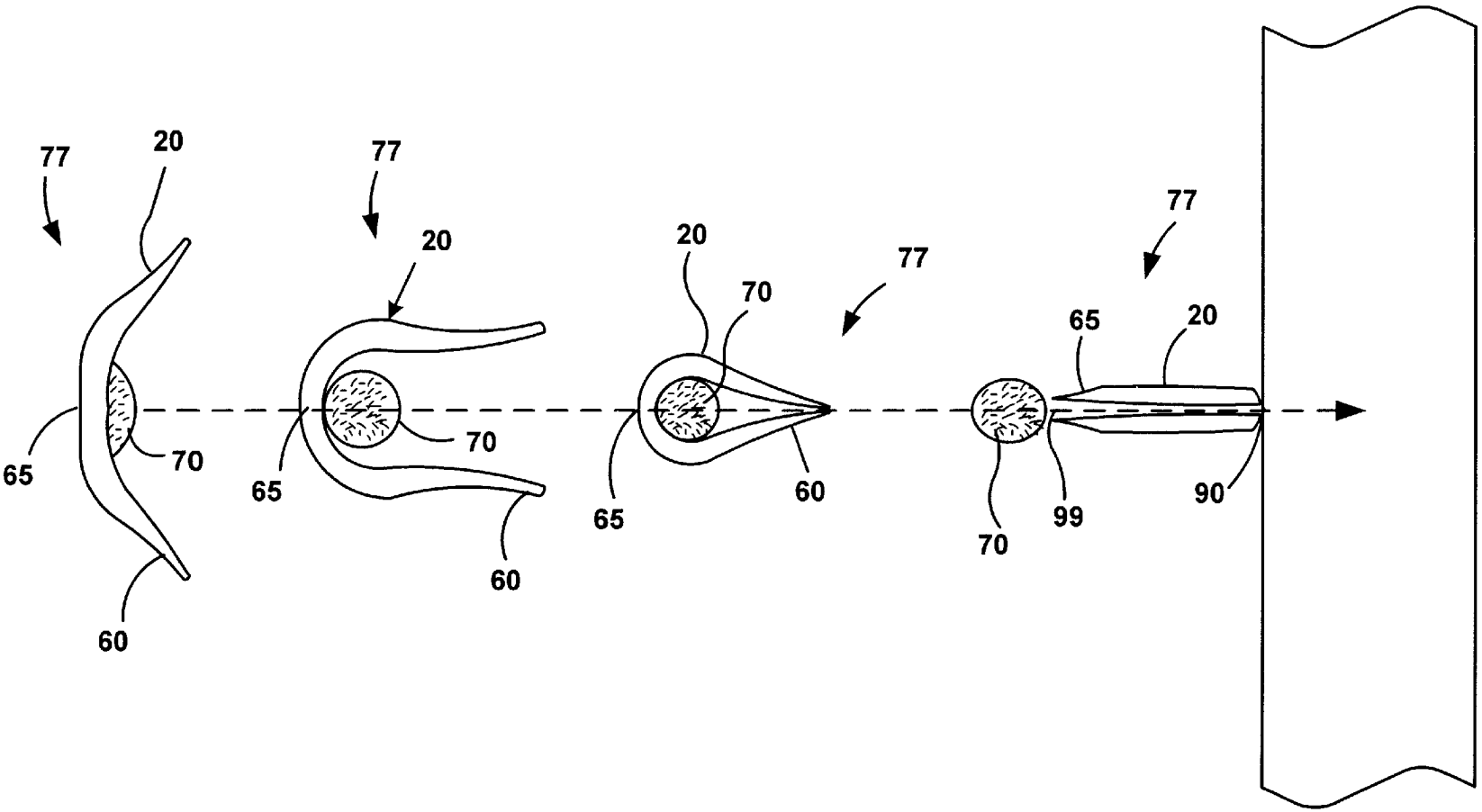
FIG. 6 is a view of a two-stage penetrator that forms part of the EFP assembly of FIGS. 4 and 5, shown in flight toward a target, after it has been fired.

In the embodiment of FIGS. 1–3, the liner(s) folds rearward, while in the embodiment of FIGS. 4–6, the liner(s) folds forward. The liners in these embodiments are designed so that the rear surface of each liner has an overall increasing or decreasing slope relative to the housing. The value of the slope determines the direction in which the liner will fold.

As the outermost liner 26 is expelled outside the housing 14, the remaining liners 20, 22, and 24 are driven outwardly until the outermost liner 24 is expelled outside the housing 14 along the trajectory 50. Similarly, the remaining liners 20 and 22 are driven outwardly until the liner 22 and thereafter the liner 20 are expelled along the trajectory 50.

Just before impact with the target (FIG. 3), the liner 26 is succeeded by the liners 24, 22 and then 20, such that the distance between a tip 80 of the first liner 26 and a tip 82 of the last liner 20 defines the penetrator length "L" of the EFP assembly 10. The penetrator length "L" can be extended to provide a more efficient penetrating force of the EFP assembly 10.

As the first liner 26 reaches and impacts the target at impact point 90, it creates a crater. When the successive liners 24, 22, and 20 reach the impact point 90, they continue the penetration process in a hammering effect, to simulate a long rod projectile.

In one embodiment, the erosion time of the first liner (or penetrator) 26 is equal to the delay time between the first liner 26 and the second timer (or penetrator) 24. This delay time can be on the order of milliseconds, but it is a function of several parameters, including velocity, penetrator diameter, length, etc. As a result, the EFP assembly 10 acts as a segmented penetrator that achieves deeper penetration by effectively producing a longer penetrator.

The present embodiment is distinguishable over conventional devices that utilize a single separator. The use of two or more separators would add significant design complexity. In fact, the complexity of utilizing multiple separators as described in the present invention could cause reflection of shockwaves between each disk-shaped liner. As an illustration, in a three disk-shaped liner configuration, as the energy passes through the first disk to the second it is bounded by the third disk and not allowed to separate and form. By not being able to form shockwaves are reflected backwards from the second disk-shaped liner towards the first. Hence, the reflecting shockwaves further distorts the formation of the middle disk shaped liner.

Other modifications may be made when implementing the invention for a particular application. For example, the liners 20, 22, 24, and 26 are separated by separators. The material of choice of the separators 87 is iron, tantalum, copper, or a material of like composition.

FIGS. 4 and 5 illustrate another embodiment of a precursor-follow through kinetic energy explosively formed penetrator (EFP) assembly 100 according to the present invention. The EFP assembly 100 generally includes a backplate 12, a housing 14, an explosive billet 16, a liner 20, and a reactive material 70. These components are assembled along a central axis 30.

The backplate 12 and the housing 14 provide a protective casing for the explosive billet 16 and the liner 20. In addition, the mass of the housing 14 provides confinement for the explosive billet 16. The addition of mass around the explosive billet 16 and the liner 20 increases the duration of the explosive impulse and hence the total energy delivered to the liner 20. The material of choice for the backplate 12 and the housing 14 is typically aluminum because of its low cost, high strength, and density. However, other materials, such as aluminum can alternatively be used, as long as the mass is sufficient to provide the necessary confinement.

The density and the physical dimensions of the explosive billet 16 are also of major importance, as they affect the deformation of the liner 20.

With reference to FIGS. 4 and 5, the liner is generally curved and dome (or bell) shaped. The liner 20 has a generally circular peripheral rim or edge 60 and a concave surface 65. The liner 20 is placed inside the housing 14 against the explosive billet 16 such that the concave surface 65 of the liner 20 is curved toward the backplate 12. The rim 60 of the liner 20 abuts against and is secured to the inner surface of the housing 14. The material of choice for the liner 20 is iron, tantalum, copper, or material of like composition, or of metallic materials such as silver, tungsten, or depleted uranium, or of other materials as described herein. The liner 20 might be approximately 0.1 inch thick if of copper, or approximately 0.120 inch thick if of Tantalum.

The reactive material 70 partly fills the liner 20 so that it is formed by the liner 20 into a desired shape, subsequent to firing. The reactive material 70 might be approximately 0.120 inch thick and 1.5 inches in diameter, and made of reactive material such as aluminum or teflon, which upon impact, give a higher burst of energy. The speed of impact could be 2 Kilometers per second if the liner 20 were made of Tantalum, or 2.7 Kilometers per second if the liners were made of copper. A recess may be provided in the housing 14 to receive one or more additional liner, i.e., 26, which could be done by machining or other physical alterations. The liners 20 and 26 could be mounted together physically, in the explosive billet's end, by a retaining ring around the liner end of the explosive billet, or even held together by glue or some bonding material, with or without a retaining ring. Although the liners are shown here as being tapered, concave shaped, lens-like, they could also in practice be made as disc-shaped, of uniform thickness, with round circumference.

In FIG. 4, section 12 forms a backplate placed flush to a hollow cylindrical housing 14 which has an inside diameter of approximately 3 to 6 inches. The cylindrical shaped explosive (billet) 16 could be made of LX-14, OCTOL, or Hand packed C-4, or some other solid explosive, and it can be machined to fit snugly within the inside of the housing, as well as to have a countersunk recess in its forward end, to receive snug placement of a liner or liners, as may be needed. The detonator is physically positioned between back plate 12 and the back end is of explosive 16.

Ordinarily, a shock wave is propagated because of the explosive burning of the billet, in the form of ever expanding hemispheres that are concentric at the detonation point (if there is a single point of detonation). However, with spaced apart, judiciously placed multiple points of detonation, the shock wave front could be more nearly like a plurality of plane waves, propagating straight forward down the housing towards the liner(s), and being nearly plane perpendicular to the central axis of the housing.

With plane waves rather than hemispherical type, e.g., it improves the chances to impart as much pressure as possible to the liner(s) to deform and propel same. The detonator could be made of RDX, PETN, RXN, for example, and could be arranged in many detonation configurations, such as by a high voltage detonator into an explosive train, or by a standard Army blasting cap, a line detonator across the back end of the explosive billet, or even plural line detonators that intersect at near equal angles through the center of the back end of the explosive billet.

Electrical wires may be run out between the back plate and back end of the explosive billet, if needed. There is a detonation delay of for instance, microseconds, causing perhaps a 5 Kilobar shock wave to propagate down the explosive until it reaches the area of the liner(s). With more powerful explosives or perhaps with multiple simultaneous detonations of the explosive, a 6 Kilobar shock wave might be generated.

With reference to FIG. 6, when the detonator assembly 35 is fired from a gun (not shown), and the detonator assembly 35 initiates the explosive billet 16, the liner 20 is accelerated forward with its outer edges 60 folding forward to form or mold the reactive material 70 in a desired aerodynamic shape. Both the expelled liner 20 and the reactive material 70 enveloped by the liner 20 form a two-stage projectile 77.

During flight, and as it approaches the target 55, the reactive material 70 perforates the concave surface 65 of the liner 20 and escapes from the liner 20 through a hole 99, separating the projectile 77 into two sections or penetrators: a precursor penetrator 20 (previously the liner 20) and a follow through penetrator 70 (previously the reactive material 70). The precursor penetrator 20 travel along a common trajectory.

As the precursor penetrator 20 reaches and impacts and penetrates the target 55 at impact point 90, and creates a crater therein. The follow through penetrator 70 containing the reactive material enters the target 55 at the crater site and causes a secondary reaction.

In one embodiment, the erosion time of the precursor penetrator 20 is equal to the delay time between the precursor penetrator 20 and the follow through penetrator 70. This delay time can be on the order of milliseconds, but it is a function of several parameters, including velocity, penetrator diameter, length, etc.

Figure 7:
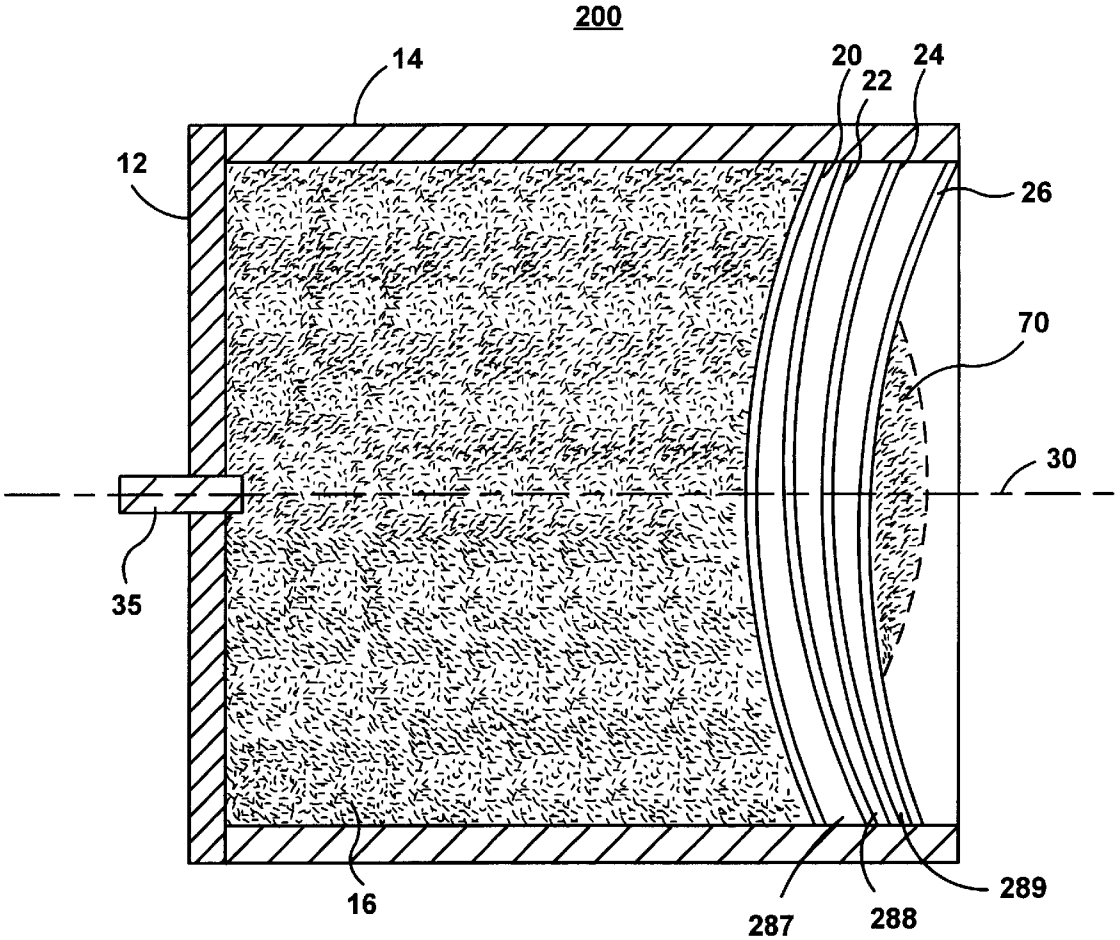
FIGS. 7 and 8 are views of another penetrator design that forms part of an explosively formed projectile assembly of the present invention, illustrating flight toward multiple targets.
Figure 8:
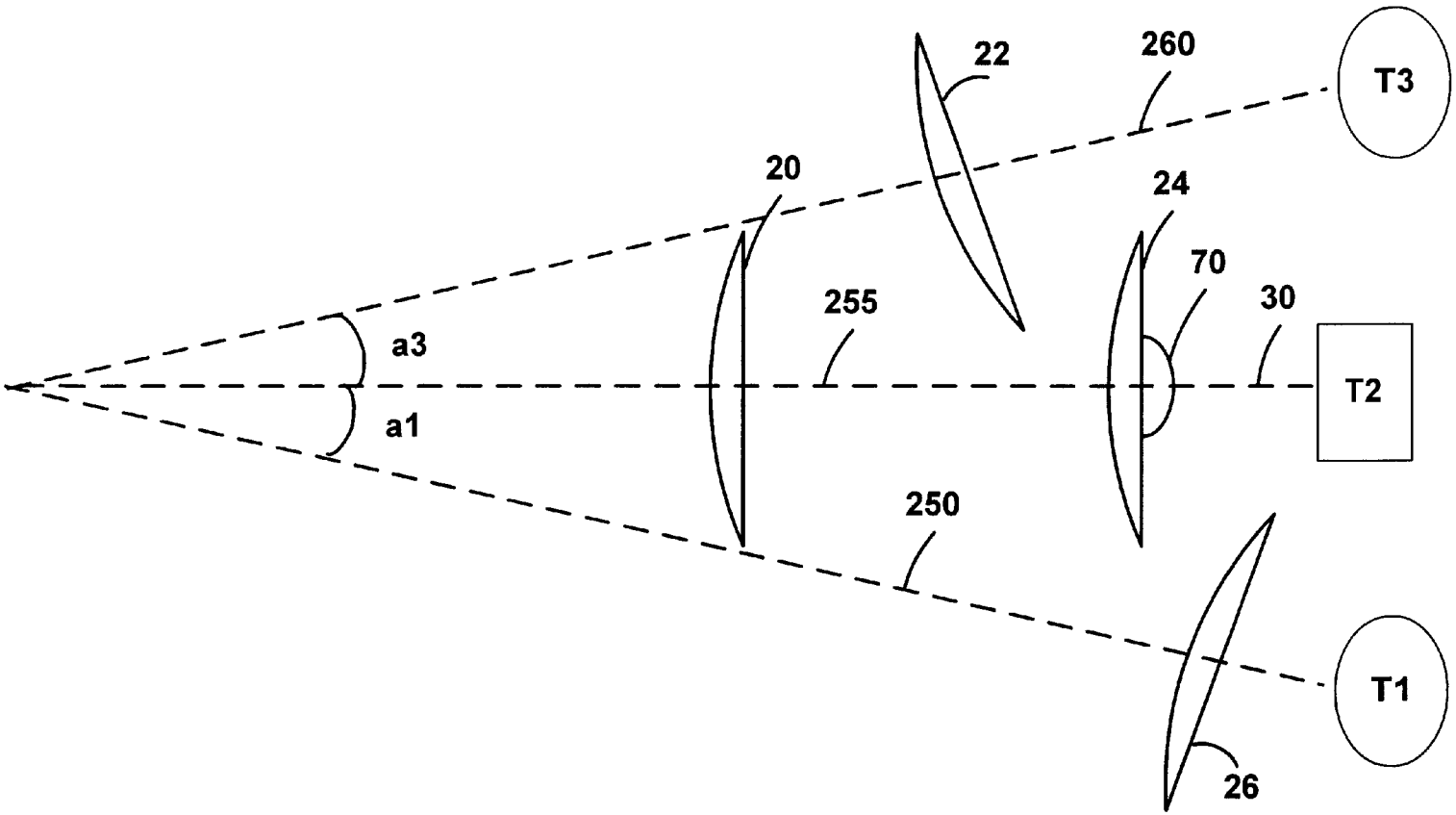

FIGS. 7 and 8 illustrate yet another embodiment of an EFP assembly 200 according to the present invention. The EFP assembly 200 can be, for example, any of the EFP assemblies 10 or 100 described earlier, and generally includes a backplate 12, a housing 14, an explosive billet 16, a plurality of liners i.e., 20, 22, 24, 26, and optionally a reactive material 70.

These components are assembled along the central axis 30, as described above. However, the EFP assembly 200 has the additional capability of utilizing a single warhead that incorporates multiple hits mechanisms. The EFP assembly 200 forms a long rod penetrator to defeat several types of targets (i.e., bunkers, armors, buildings, missiles) within the same warhead. In one specific embodiment of the EFP assembly 200, one of the expelled liners contains the reactive material 70 which further destroys, or neutralizes, or otherwise reacts with, whatever it comes into contact with.

In this embodiment, the EFP assembly 200 is shown as including multiple liners, only four of which, i.e., 20–26, are illustrated. These liners 20–26 are separated by separators, such as separators 287, 288, 289, wherein, in a preferred embodiment, two adjacent liners are separated by a separator. The separators 287, 288, 289 are non-symmetrically disposed relative to the axis 30, in order to divert the liners (or penetrators) 20–26 toward multiple targets, such as targets T1, T2, T3.

In the example shown in FIGS. 7 and 8, the liners 20–26 could fold either forwardly or rearwardly as described earlier, or they could maintain their original or another desired shape along their respective trajectories 250, 255, 260. The liners 22 and 26 are diverted from the reference trajectory 255 of the liners 20, 24 because, as shown in FIG. 7, the separator 287 imparts a positive angle "a3" to the liner 22, while the separator 289 imparts a negative angle "a1" to the liner 26.

When the explosive shock wave comes in contact with the angled separators 287, 288, 289, the normal pressure forces are translated at their respective angles of deviation from the axis 30, to the next liner in the configuration, causing the latter liner to be propelled towards its designated target at that given angle of deviation.

According to another embodiment of the present invention, the liners 20–26 can be deviated from a reference trajectory, by varying the densities or other characteristics of the liners 20–26. The EFP assemblies 10, 100, or 200 of FIGS. 1–8 could be used to implement this embodiment. The variable densities of the seperators (or liners) vary the separation distances between them.

According to still another embodiment, the separators can have varying thicknesses in order to vary the separation thicknesses between the liners 20–26. The variable thickness allows for separation which can vary from none to a given distance. Zero separation allows the penetrators to be attached for deep penetration, and more separation allows for the penetrators to be diverted towards different/multiple targets.

It should be understood that the geometry and dimensions of the components described herein may be modified within the scope of the invention and are not intended to be the exclusive; rather, they can be modified within the scope of the invention. Other modifications may be made when implementing the invention for a particular application.

What is claimed is:

1. A segmented, kinetic energy, explosively formed penetrator assembly, comprising:

a housing having an inner surface and a central axis;

a plurality of liners that are separated from each other, and that are stacked within the housing along the central axis of said housing to at least fill the space between the innermost of said liners and the inside of said housing;

a plurality of separators that are interposed between the liners;

an explosive billet disposed within the housing;

wherein at least two of said separators are asymmetrically disposed with respect to said central axis in order to divert the relative position of adjacent liners so that such liners will have divergent flight trajectories to be capable of reaching respective multiple targets, and wherein at least one liner folds forwardly after it is expelled from the housing causing said at least one liner to envelope a reactive material disposed within said at least one liner.

2. A kinetic energy, explosively formed penetrator assembly, comprising:

a housing having an inner surface and a central axis;

an explosive billet disposed within the housing;

a plurality of liners disposed against the explosive billet within the housing wherein at least two of said liners are asymmetrically disposed with respect to said central axis in order to divert the relative position of adjacent liners so that such liners will have divergent flight trajectories to be capable of reaching respective multiple targets;

a reactive material disposed within one of said liners; and wherein each of the liners includes a peripheral rim;

wherein the peripheral rim of each liner is assembled to abut against the inner surface of the housing;

wherein when the liners are expelled from the housing, the peripheral rim of each liner folds forwardly, causing said one of said liners to the reactive material to form a two-stage penetrator; and wherein at least one liner of the plurality of liners is diverted from a flight trajectory of another liner, so that the plurality of liners could reach multiple targets.

3. The penetrator assembly according to claim 2, wherein the two-stage penetrator includes a precursor penetrator formed of the liner, and a follow through penetrator comprised of the reactive material.

4. The penetrator assembly according to claim 2, further including a backplate.

5. The penetrator assembly according to claim 2, further including a detonator assembly that initiates the explosive billet.

6. The penetrator assembly according to claim 2, wherein said one of said liners folding forwardly during detonation can mold some of the reactive material to form a predetermined aerodynamic shape during flight of such material.

7. The penetrator assembly according to claim 6, wherein after firing, the reactive material perforates said one of said liners and separates from said one of said liners, forming the precursor penetrator and the follow through penetrator.

8. The penetrator assembly according to claim 7, wherein the follow through penetrator causes a secondary reaction after it enters a target.

* * * * *